United States Patent [19]

Minshull

[11] 4,329,927

[45] May 18, 1982

[54] RAILWAY CAR ROPING STAPLE

[75] Inventor: Thomas R. Minshull, Greenville, Pa.

[73] Assignee: Greenville Steel Car, Greenville, Pa.

[21] Appl. No.: 148,279

[22] Filed: May 9, 1980

[51] Int. Cl.[3] ..... A44B 13/00; B61J 3/10; B66C 17/26

[52] U.S. Cl. ..... 105/462; 24/225; 24/230.5 R; 105/1 A; 294/82 R

[58] Field of Search ..... 24/225, 230.5 R; 105/1 A, 462; 294/82 R

[56] References Cited

U.S. PATENT DOCUMENTS

| | | | |
|---|---|---|---|
| 728,212 | 5/1903 | Drayer | 105/462 |
| 1,126,282 | 1/1915 | Riley | 294/82 R X |
| 1,341,787 | 6/1920 | Drayer | 105/462 |
| 1,572,347 | 2/1926 | Beck | 24/230.5 R |
| 1,631,677 | 6/1927 | Garrett | 105/462 X |
| 2,986,421 | 5/1961 | Grove | 294/82 R |
| 3,299,628 | 1/1967 | Chisler | 294/82 R X |
| 3,480,319 | 11/1969 | Raschke | 294/82 R |
| 3,752,083 | 8/1973 | Bitterberg | 105/1 A |
| 3,995,822 | 12/1976 | Einhorn et al. | 24/230.5 R X |

*Primary Examiner*—Joseph F. Peters, Jr.
*Assistant Examiner*—Howard Beltran
*Attorney, Agent, or Firm*—Webb, Burden, Robinson & Webb

[57] ABSTRACT

A roping staple (and lifting lug) especially for securing to the side sill of a railroad car. The roping staple is uniquely provided with the strength and accessibility required for modern day railroading and yet is suitable for economical construction.

4 Claims, 4 Drawing Figures

RAILWAY CAR ROPING STAPLE

BACKGROUND

From time to time, railroad cars derail and must be lifted and placed back upon the rails. The modern technique for rerailing cars is to lift them with a large crane having a lifting cable that terminates in a hook, generally a foundry (or factory) hook. The Association of American Railroads has recommended a provision for lifting a freight car comprising an opening in the horizontal structure such as a horizontal flange of the side sill or an opening in the bottom plate of the body bolster. This provision has the definite disadvantage of weakening the railroad car understructure at the side sill and/or the bolster. Thus, the understructure is weakened at the very location where strength is most needed during the lifting and rerailing of the railroad car. Consider that the same recommendation requires that the provision be designed to withstand a force of 40% of the gross weight applied at 15° of the vertical axis of the upright car. (AAR Standard S-234-78). The load must be supported without exceeding the yield strength of the material comprising the understructure except for very local deformation permitted to achieve bearing area.

Roping staples are longitudinal and vertical openings that serve the function of "cabling" cars. Cabling is a technique for towing railroad cars from a vehicle travelling substantially parallel to the track upon which the railroad car rides. The Association of American Railroads recommends that the roping staple be designed to pull 6 fully-loaded cars equipped with roller bearings on tangent track with a 1% grade (AAR Standards).

Typically, the railroad cars are cabled or pulled by a car puller located adjacent the track upon which the car is loaded. For design purposes, the cable load is considered 22,000 pounds and the cable is considered to be at an angle of 10° horizontally and 10° vertically from the roping staple. The roping staple must withstand the forces applied by the pulling cable and facilitate direct access.

U.S. Pat. Nos. 728,212 and 1,341,787 are directed to roping staples and lifting lugs for securing to the side sill of a railroad car near the side bolster. Each of these patents discloses a device that does not require holes be placed in the side sill and/or bolster except for the fasteners.

The earlier patent merely discloses a roping hook which is not arranged to accommodate a lifting hook except a very large angle be formed between the plane of symmetry of the hook and the vertical cable to which the hook is attached. The latter patent discloses a very complex shape which probably can only be formed by casting. The casting has an opening for receiving a hook which will form a large angle between the plane thereof and the vertical cable. In each case, the lifting hook is supported by the tensile strength of the annular portion of the device surrounding the opening in which a hook may be placed much the same as a chain length supports a tensile load of the chain.

It is an object of this invention to provide a simple, rugged device which can be bolted or welded to the side sill near the bolster to provide a location at which a lifting hook can be inserted and/or cables for cabling can be secured. The load is transferred from the lifting hook to the underframe through the device substantially entirely by compressive forces. Moreover, aside from bolt or rivet holes, there is no need to place holes in the elements comprising the understructure of the railroad car thus preventing an undesirable weaking of the understructure where strength is especially required. The hook of the type currently used for rerailing cars (for example a 504 factory hook) can directly engage the device eliminating any requirements for auxiliary chains and hooks.

SUMMARY OF THE INVENTION

Briefly according to this invention, there is provided a roping staple for attachment to the underface of a side sill of a railroad car comprising a ring shaped portion having an inverted stirrup shape. The ring shaped portion further comprises a generally horizontal portion having a cylindrical surface and a U-shaped portion having a generally toroidal surface. According to a preferred embodiment, the ring shaped portion is forged. According to yet another embodiment, the roping staple is provided with a bracket having an upwardly extending flange and a horizontally extending flange. The ring shaped portion is then attached to the underface of the horizontal flange and the bracket is secured as by bolting or riveting to the side sills of a railroad car. Where no bracket is used but merely the ring shaped portion, the ring shaped portion has an upper surface that is flat and which may be welded along the edges thereof to the underface of the side sill. It is preferred according to this invention that the radius of curvature of the cylindrical surface of the horizontal part of the ring shaped portion is greater than the radius of curvature of the curves generating the toroidal surface of the generally U-shaped portion. It is further preferred that if the ring shaped portion is secured to a bracket, that the approximate plane of symmetry of the ring shaped portion be offset from the planes defined by the faces of the vertical flange comprising the bracket. The offset is preferably toward the outside of the railroad car to which the bracket is secured, thus enabling the contact between the roping staple and the lifting hook to be substantially beneath the lifting cable.

THE DRAWINGS

FIGS. 1 and 2 relate to an embodiment of this invention which device is made by casting and machining, for example, and can be riveted or bolted to the side sill of a railroad car;

FIGS. 3 and 4 relates to an embodiment of this invention which is a forged device and can be welded directly to the underface of a side sill of a railroad car.

DESCRIPTION OF THE PREFERRED EMBODIMENTS

Throughout this application, the applicant's invention has been referred to as a "roping staple". However, only one of its functions is that of a roping staple. It is also a lifting lug.

The underframe of a railroad freight car typically comprises a center sill which is an elongate horizontal beam along the center line of the railroad car. At two locations near each end of the center sill, center plate assemblies are secured to center sill. The wheel trucks are pivotally secured to the center plates for rotation around generally vertical axes. Extending transverse of the center sill, usually at least outward of the center plates are tranverse bolsters which are simply cross beams forming the beam surfaces for the floor and/or body of the railroad car. Side sills are beams parallel to the center sill near the outer edge of the car secured to the ends of the transverse bolsters. Typically the couplers between the cars are secured directly to the center sills. The side sills are variously channeled beams or angle beams. The lower horizontal flange of the beams comprising the side sill may point inwardly or outwardly.

When a car is lifted by crane for rerailing, it is engaged at the side sill near the bolsters or at the trucks themselves (see, for example, U.S. Pat. No. 3,752,083). Occasionally it is desirable to chain the trucks to the underframe prior to lifting the freight car because the suspension system will expand as the weight of the railroad car is lifted off of the truck.

Figure 1:
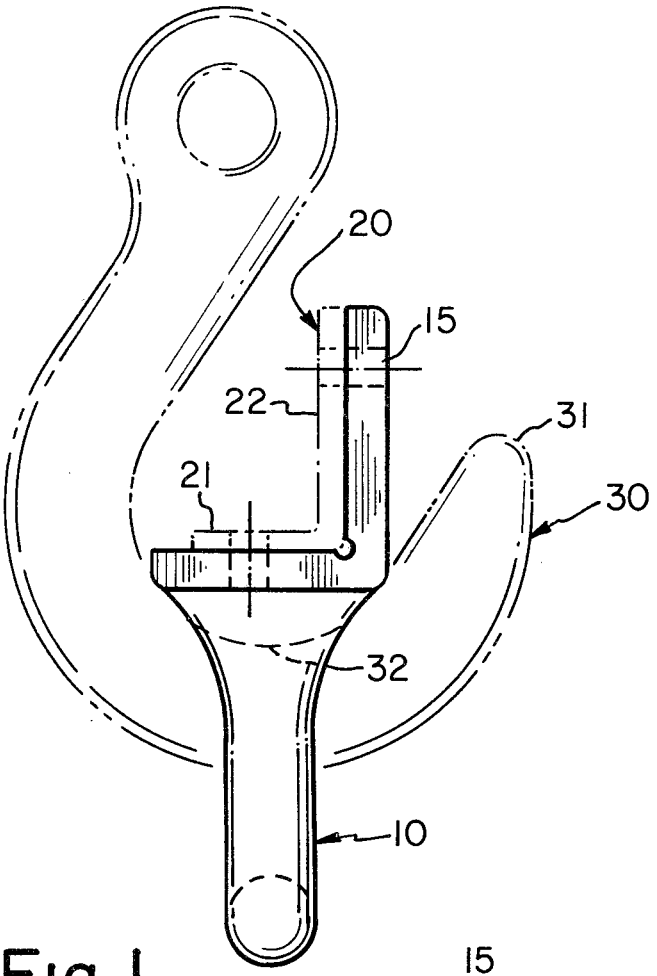

Referring now to FIG. 1, there is illustrated a roping staple 10 and shown in dashed lines a section of a side sill 20 and a factory hook 30. The particular side sill shown is of the type having a horizontal web 21 and a vertical web 22 formed together along abutting edges. The section of the side sill illustrated is taken to just one side or the other of the location at which the transverse bolster joins the side sill. Thus the end of the hook 31 will not be obstructed and the hook can engage the roping staple near its cradle 32. The particular side sill illustrated has an outwardly directed horizontal flange. The roping staple comprises an angle beam or bracket portion 11 and a D-shaped ring portion 12. The ring portion may be variously shaped but preferably resembles an inverted stirrup having a horizontal upper portion 13 and having a cylindrical surface and a U-shaped portion 14 depending therefrom. It is cylindrical in that it is a surface generated by a line (the generatrix) which moves so that it intersects a plane curve (the directrix) and always remains parallel to a fixed line that lies outside of the plane curve. Preferably, all or at least a portion of the directrix comprises a portion of a circle. The cylindrical horizontal portion 13 of the ring portion is essential as will be explained. The bracket portion 11 and ring portion 12 are either a unitary structure or are fastened together by welding. The inner surface of the U-shaped portion 14 has a portion that is generally toroidal. It is toroidal in that it is a surface shaped somewhat like a donut generated by the spacial rotation of a circle or a portion thereof about an axis which is in its plane, but does not intersect it. This insures that the hook will not wedge. The D-shaped ring portion of the roping staple 12 is generally symmetrical about a plane passing through all parts of the ring. This plane is, of necessity, offset from the plane of the faces of the horizontal web of the bracket portion 11 of the roping staple. However, the offset may be beneficial if it moves the ring portion outwardly from the center of the car body. In this instance it permits the cable from which the hook is supported to move more or less directly vertically upward of the location where the cable engages the hook and the hook engages the roping staple. As mentioned above, the horizontal portion 13 of the ring portion of the staple is essential. It has a cylindrical surface for bearing upon the cradle portion of the hook to thus provide a seat for the hook substantially aligned with the cable to which the hook is attached. The forces from the hook are directed upward to the angle portion of the staple and thus to the side sill. In a preferred embodiment illustrated in FIGS. 1 and 2, the radius of curvature of the cylindrical horizontal portion of the ring is just less than that of the hooks that might be used therewith. Thus the hook will seat over a larger area.

The horizontal and vertical webs or flanges of the bracket portion are provided with openings 15 through which fasteners (rivets or bolts, for example) may be passed to secure the staple to the side sill. The most severe load the staple will encounter are those when a lifting hook is inserted therein and the railroad car to which it is attached is being rerailed. Note that the fasteners are not load carrying in this instance. The upper surface of the horizontal web of the staple is simply pressed tightly against the lower face of the horizontal web or flange of the side sill. When the roping staple is to secure a cable for towing the railroad car from a vehicle on a path generally parallel to the track, the forces on the staple are much smaller and are easily handled by the fasteners.

Figure 2:
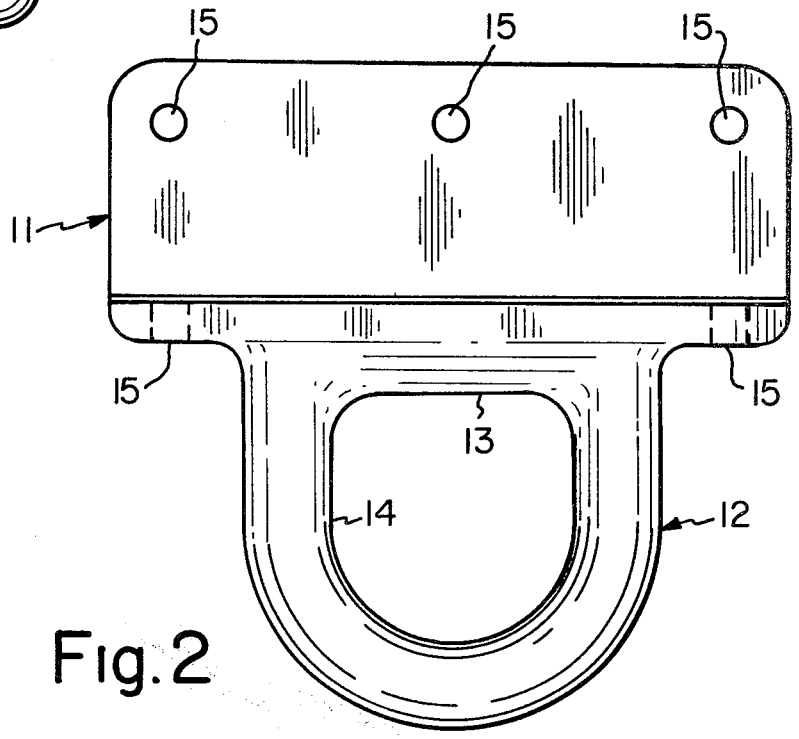

The roping stable described with reference to FIGS. 1 and 2 may be made as unitary pieces by casting and subsequent machining. On the other hand, the ring portion may be forged and the bracket portion rolled and the two portions welded together.

Figure 3:
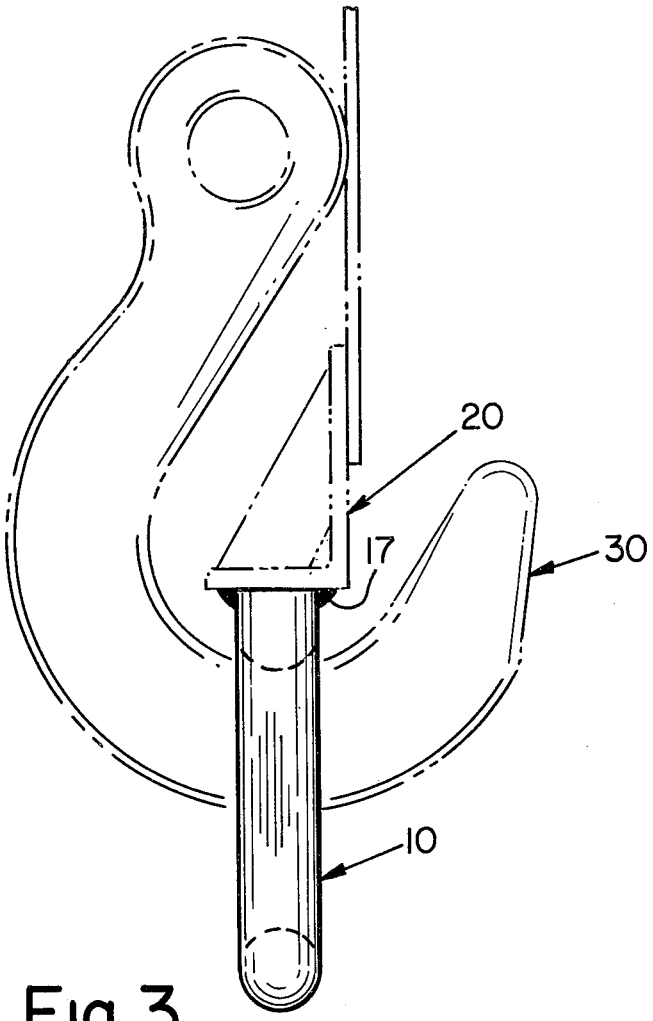
Figure 4:
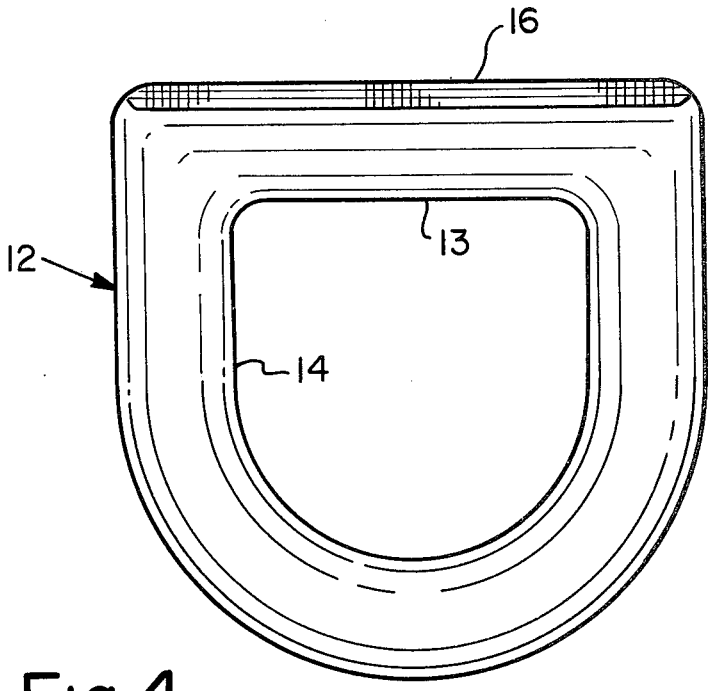

FIGS. 3 and 4 illustrate another embodiment of this invention which is less expensive and lighter weight than that described with reference to FIGS. 1 and 2. In FIGS. 3 and 4, elements corresponding to those described for FIGS. 1 and 2 bear like identifying numerals. An inverted stirrup shaped ring is forged with a very flat upper horizontal surface 16. The forged ring is then welded directly to the underface of the side sill of a freight car. Because of the overall design, the welded attachment 17 provides sufficient strength. As with other embodiments, the greatest loads are encountered when the roping staple is being used for rerailing. In this instance, most of the load from the crane hook is transferred to the side sill by compression of the horizontal portion of the ring to the side sill and the welds are not strained beyond their strength.

Having thus defined my invention in detail and with particularity required by the Patent Laws, what is desired protected by Letters Patent is set forth in the following claims.

I claim:

1. A roping staple for attachment to an underface of a side sill of a railroad car comprising a bracket having an upwardly extending flange and a horizontally extending flange, a D-shaped ring portion having an inverted stirrup shape, said ring portion further comprising a generally horizontal portion having an arcuate inner surface and a generally U-shaped portion having a generally arcuate surface, an upper surface of the horizontal portion of said ring portion being attached to the horizontal flange of the bracket for transmitting a lifting force to the side sill.

2. A roping staple according to claim 1 wherein the radius of curvature of the arcuate inner surface of the horizontal portion of the ring is greater than the radius of curvature of the curve generating the arcuate surface of the generally U-shaped portion.

3. A roping staple according to claims 1 or 2 wherein said ring portion has a plane of approximate symmetry which plane is offset from the faces of the vertical flange comprising a portion of the bracket.

4. A roping staple permanently attached to an underface of a side sill of a railroad car comprising A D-shaped ring being an inverted stirrup shape, said ring further comprising a generally horizontal portion having an arcuate inner surface and a generally U-shaped portion having a generally arcuate surface, said horizontal portion having a flat upper surface secured as by welding to the undeface of a side sill for transmitting a lifting force to the side sill.

* * * * *